US010182604B2

(12) United States Patent
Cherin et al.

(10) Patent No.: US 10,182,604 B2
(45) Date of Patent: Jan. 22, 2019

(54) CAP PROTECTOR

(71) Applicants: Joshua Cherin, Mission Viejo, CA (US); Karl Burns, San Clemente, CA (US); Douglas Davidson, Costa Mesa, CA (US)

(72) Inventors: Joshua Cherin, Mission Viejo, CA (US); Karl Burns, San Clemente, CA (US); Douglas Davidson, Costa Mesa, CA (US)

(73) Assignee: New Era Cap Co., Inc., Buffalo, NY (US)

( * ) Notice: Subject to any disclaimer, the term of this patent is extended or adjusted under 35 U.S.C. 154(b) by 1285 days.

(21) Appl. No.: 13/909,659

(22) Filed: Jun. 4, 2013

(65) Prior Publication Data

US 2013/0318688 A1 Dec. 5, 2013

Related U.S. Application Data

(60) Provisional application No. 61/655,132, filed on Jun. 4, 2012.

(51) Int. Cl.
*A42B 1/02* (2006.01)
*A47G 25/10* (2006.01)

(52) U.S. Cl.
CPC ..... *A42B 1/02* (2013.01); *A47G 25/10* (2013.01)

(58) Field of Classification Search
CPC ..... A42B 1/24; A42B 1/004; A42B 1/248; A42B 1/245; A42B 1/006; A42B 1/241; A42B 1/244; A42B 1/247; A42B 1/18; A42B 1/067; A42B 1/242; A42B 1/041; A42B 1/201; A42B 1/203; A42B 3/003; A42B 3/04; A42B 3/046; A42B 1/062
USPC ..... 2/209.13, 46, 411, 425, 181
See application file for complete search history.

(56) References Cited

U.S. PATENT DOCUMENTS

| | | | | |
|---|---|---|---|---|
| 4,805,782 A * | 2/1989 | Hale et al. | ..... | 211/30 |
| 5,012,531 A * | 5/1991 | Schoonover | ..... | 223/66 |
| 5,411,144 A | 5/1995 | Deupree | | |
| 5,481,759 A | 1/1996 | Rinaldi | | |

(Continued)

FOREIGN PATENT DOCUMENTS

| | | |
|---|---|---|
| JP | 3033247 U9 | 10/1996 |
| JP | 2004-11039 A | 1/2001 |

OTHER PUBLICATIONS

Japanese Office Action dated Mar. 7, 2017 English translation provided by agents at Asamura Patent Office (7 pages).

*Primary Examiner* — Alissa L Hoey
*Assistant Examiner* — Catherine M Ferreira
(74) *Attorney, Agent, or Firm* — Harter Secrest & Smery LLP

(57) ABSTRACT

A protector for a cap having a crown and a bill, the crown comprising a front part and a rear part defining an interior cavity for the head of a wearer, the protector comprising a substantially rigid body having a front half-domed surface shaped to follow contours of the front part of the crown, a retaining element configured to extend from a first connection on a left side portion of the body around an outer front surface of the front part of the crown above the bill to a second connection on a right side portion of the body, the body and retaining element configured so the front surface of the body engages the outer rear surface of the rear part of the crown when the rear part is folded into the front part.

17 Claims, 12 Drawing Sheets

(56) References Cited

U.S. PATENT DOCUMENTS

| | | | | |
|---|---|---|---|---|
| 5,725,134 | A * | 3/1998 | Weltge | 223/24 |
| 5,921,403 | A | 7/1999 | Coffaro | |
| 6,523,728 | B2 | 2/2003 | Lee | |
| 6,612,472 | B1 * | 9/2003 | Zakarin | 224/652 |
| 6,647,554 | B1 * | 11/2003 | Yan | 2/209.13 |
| 7,043,761 | B2 | 5/2006 | Epling | |
| 7,096,512 | B2 | 8/2006 | Blair | |
| 7,380,691 | B2 | 6/2008 | Kroll et al. | |
| 7,966,673 | B1 | 6/2011 | Gibson | |
| 2005/0086727 | A1 * | 4/2005 | Shen | 2/411 |
| 2009/0222975 | A1 | 9/2009 | Green et al. | |
| 2010/0122399 | A1 * | 5/2010 | Odom | 2/181 |
| 2010/0138980 | A1 | 6/2010 | Duda et al. | |
| 2011/0179557 | A1 | 7/2011 | Rabie | |
| 2011/0302697 | A1 | 12/2011 | Jaquez et al. | |
| 2011/0307997 | A1 | 12/2011 | Blair | |

* cited by examiner

CAP PROTECTOR

TECHNICAL FIELD

The present invention relates generally to the field of baseball type caps, and more particularly to an improved cap protector and attachment system.

BACKGROUND ART

U.S. Pat. No. 6,523,728, entitled "PVC Cap Packaging Insert," is directed to a cap packaging insert shaped and sized to follow the inner surface contours of the front portion of a baseball cap and to be retained in place by inserting it inside the sweatband of the cap.

U.S. Pat. No. 7,043,761, entitled "Removable Insulated Head Gear Lining," is directed to removable liners for head gear specially configured for placement within a cap or hat for enhanced thermal comfort.

U.S. Pat. No. 7,380,691, entitled "Cap Shape Supporting and Form Maintaining Device, AKA 'Hat Noodle' and Method of Storage for Cap," is directed to a shape supporting or form-maintaining device for a cap having a plurality of slots that allow for adjustment of its size and form to the size and form of the subject cap.

U.S. Patent Publication No. 2011/0302697, entitled "Safety Headwear System Having Interchangeable Outer Coverings for Providing Customizable Appearance," is directed to a system for interchangeable customized headwear that includes safety features designed to protect the head and that includes a plurality of covering connectors configured to couple to associated shell connectors.

BRIEF SUMMARY OF THE INVENTION

With parenthetical reference to the corresponding parts, portions or surfaces of the disclosed embodiment, merely for the purposes of illustration and not by way of limitation, the present invention provides an improved protector (15) for a cap (50), the cap having a generally domed crown (51) and a bill (52) connected to the crown and extending away from the crown, the crown comprising a front generally half-domed part (53) and a rear generally half-domed part (54), the front part having an outer front surface (55) and an inner front surface (56), the rear part having an outer rear surface (58) and an inner rear surface (59), the inner front surface and the inner rear surface defining an interior cavity for receiving the head of a wearer, comprising a substantially rigid body (16, 116, 216) having a front generally half-domed surface (18, 118, 218) shaped and sized to follow contours of the front part of the crown of the cap, a left side portion (19, 119, 219) and a right side portion (20, 120, 220), a retaining element (25, 125, 225) configured and arranged to extend from a first connection (23, 123, 223) on the left side portion of the body around the outer front surface of the front part of the crown above the bill to a second connection (24, 124, 224) on the right side portion of the body, wherein the body and the retaining element are configured and arranged such that the front surface of the body engages the outer rear surface of the rear part of the crown when the rear part is folded into the front part at a substantially transversely extending fold (60), and wherein the shape of the front part of the crown is protected by the front surface of the body.

The body may comprise plastic. The retaining element may comprise a woven twill strap (26). The retaining element may be adjustable in length. The retaining element may be elastic. The first connection and the second connection may be removable connections (23). The first connection and the second connection may each comprise a hook (28, 29) and an opening (21, 22) in the body for receiving the hook. The first connection and the second connection may be fixed connections (123, 124, 223, 224). The first connection and the second connection may comprise a rivet (123) or a bar tack (223, 224). The body may comprise a connecting element (40) for removably connecting the body to a bag or pack, and the connecting element may comprise a hook. The left side portion and the right side portion may be sized to extend rearwardly beyond the cap fold.

The cap protector may further comprise a carrier (400) having a flexible pocket (401) configured and arranged to receive the cap protector in engagement with a cap. The carrier may comprise a pack and the pocket may be located on the top of the pack and include a zipper closure (402). The pocket may include an interior first connecting element (403) and the body may comprise a second connecting element (40) for removably connecting the body to the first connecting element of the pocket. The first connecting element may comprise a ring and the second connecting element may comprise a latch hook.

DESCRIPTION OF THE PREFERRED EMBODIMENTS

Figure 1:
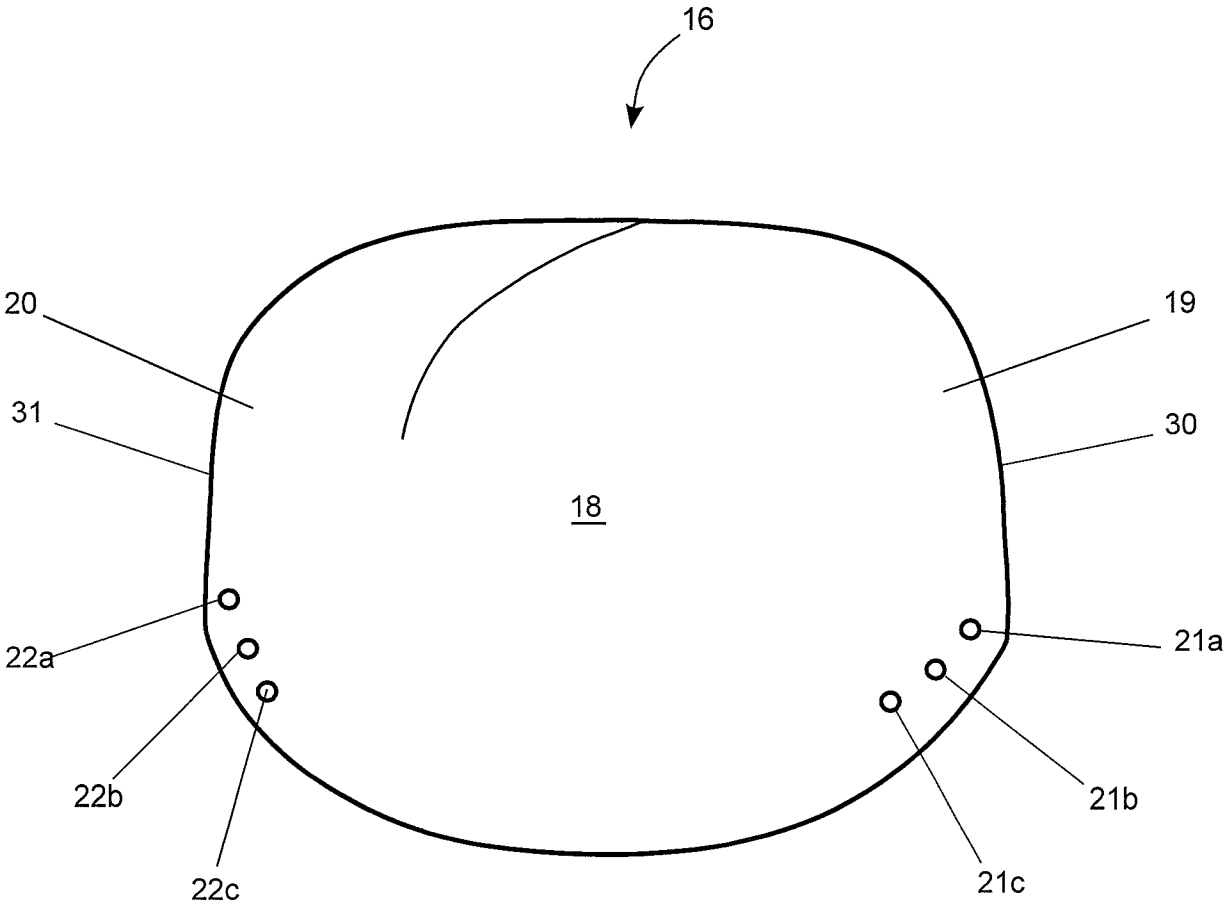
FIG. 1 is a perspective view of a first embodiment of the body of the cap protector.
Figure 2:
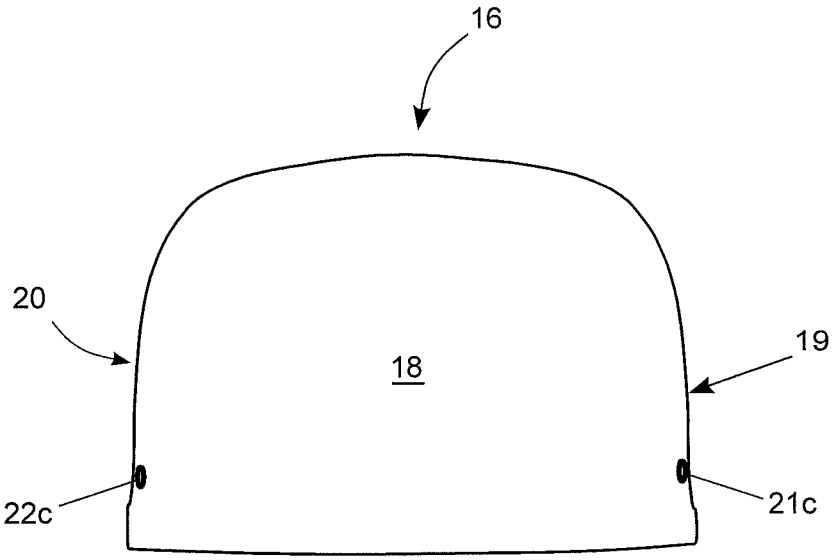
FIG. 2 is a front view of the body shown in FIG. 1.
Figure 3:
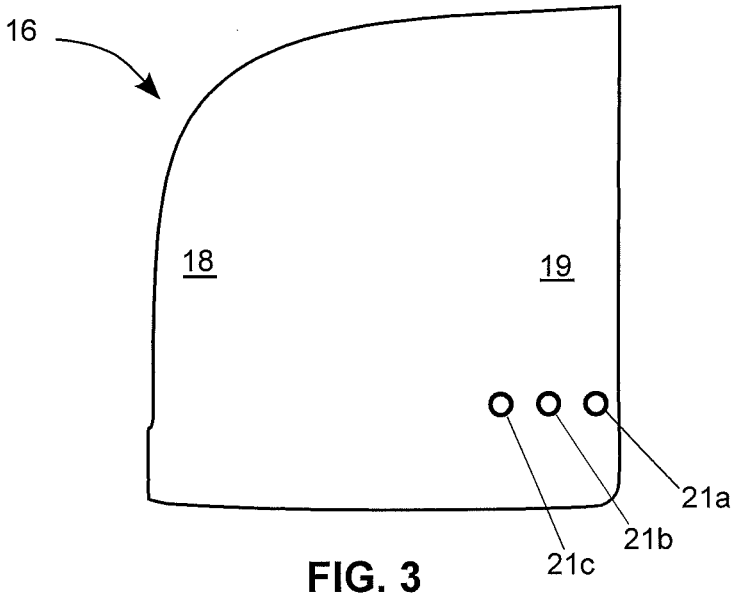
FIG. 3 is a side view of the body shown in FIG. 1.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or of rotation, as appropriate.

Figure 5:
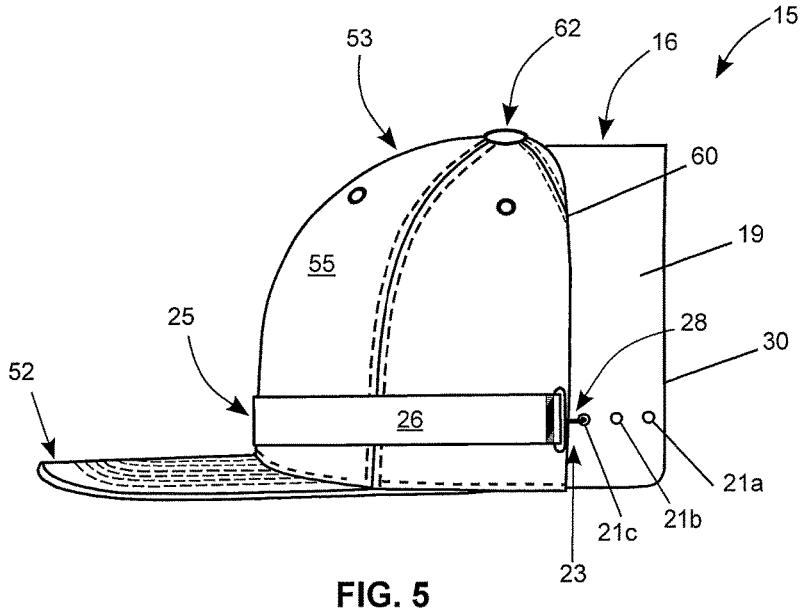
FIG. 5 is a side view of the cap protector shown in FIGS. 1 and 4 in engagement with a conventional baseball cap.

Referring now to the drawings, and more particularly to FIG. 5 thereof, this invention provides an improved cap protector, a first embodiment of which is generally indicated at 15. As shown, cap protector 15 broadly includes substantially rigid body 16 and retaining element 25 connected to body 16.

Figure 18:
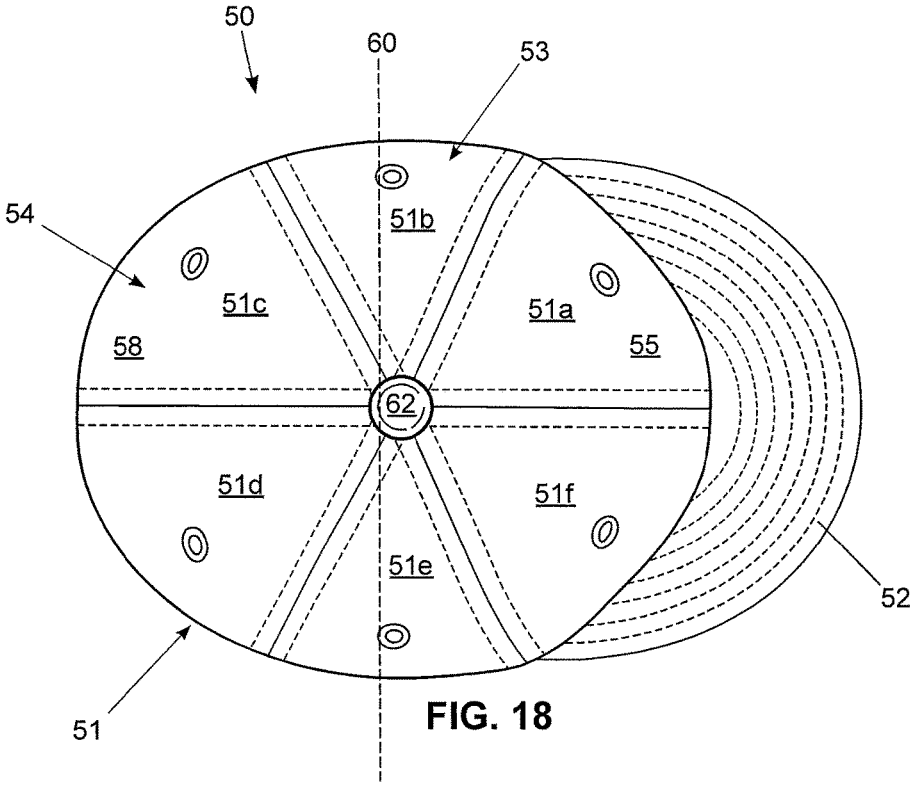
FIG. 18 is a top plan view of the cap shown in FIGS. 5 and 12 unfolded.
Figure 19:
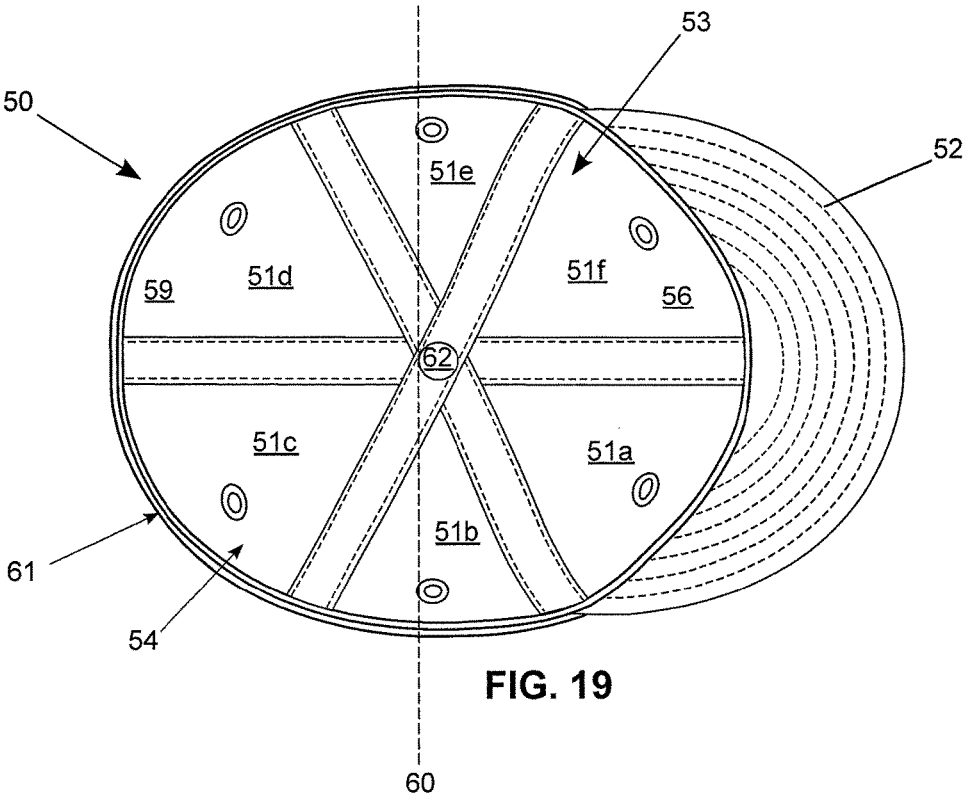
FIG. 19 is a bottom view of the cap shown in FIG. 18.

As shown in FIGS. 18 and 19, cap 50 broadly includes crown 51, headband 61 and bill or visor 52. Crown 51 is formed from six adjoining panels or segments, severally indicated at 51*a-f*. Panels 51*a-f* are sewn together at seams that extend radially from apex 62 and the inside of each seam is covered with seam tape. Each panel 51*a-f* includes a sewn eyehole. In the preferred embodiment, the front two panels 51*a* and 51*f* are supported by a plastic woven filament or polyester buckram, which helps support the front of the cap and retain its shape. However, this support can be crushed or deformed and retaining its shape during storage or travel can be a concern.

Bill or visor 52 is connect to the bottom of and extends across the front two panels 51*a* and 51*f* of crown 51 and projects angularly down and away from the front of crown 51. Visor 52 can be pre-curved and is formed of conventional visor board, with a visor top layer and an under-layer.

As shown, panels 51*a* and 51*f* and the front portion of side panels 51*b* and 51*e* form front part 53 of crown 51. Rear panels 51*c* and 51*d* and the rear portions of side panels 51*b* and 51*e* form rear part 54 of crown 51. Front part 53 of crown 51 has outer surface 55 and inner surface 56. Rear part 54 of crown 51 has outer rear surface 58 and inner rear surface 59. Headband or sweatband 61 is attached to the bottom inner peripheral edge of crown 51. Headband 61 can be an adjustable headband that allows adjustment to the head size of the particular wearer or it can be a fitted cap which is not adjustable. Inner front surface 56 and inner rear surface 59 of crown 51 are configured to receive the head of the wearer.

Figure 6:
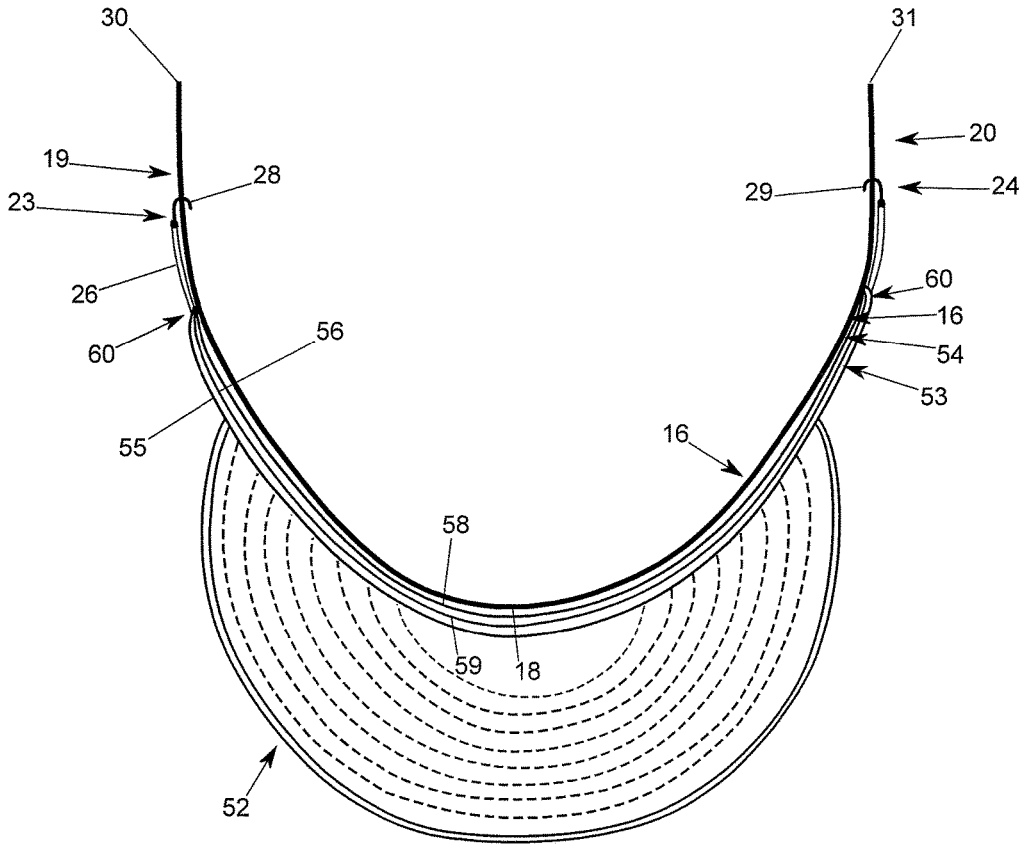
FIG. 6 is a bottom view of the cap protector shown in FIG. 5 in engagement with a conventional baseball cap.
Figure 12:
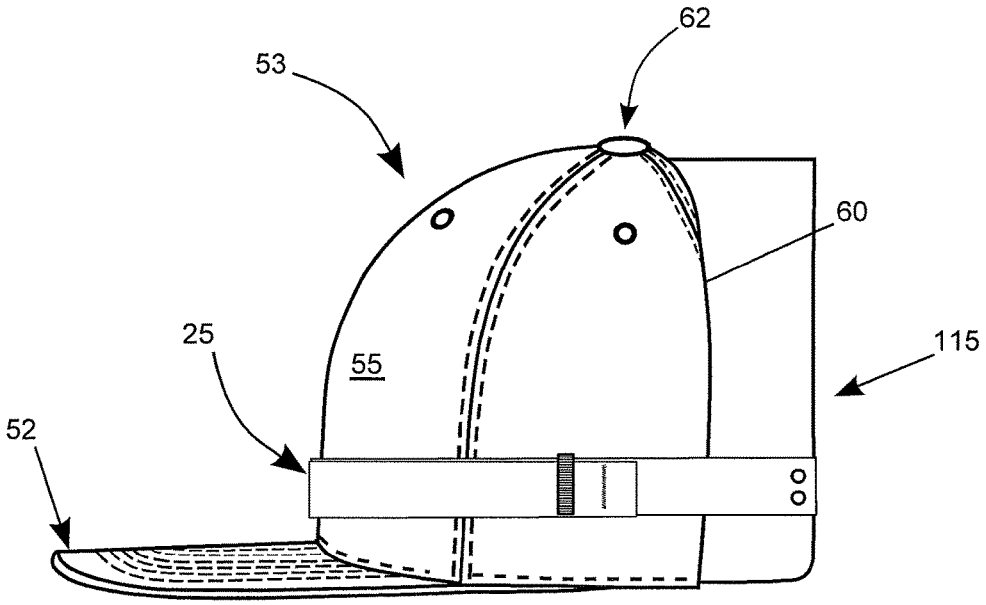
FIG. 12 is a side view of the cap protector shown in FIG. 9 in engagement with a conventional baseball cap.

As shown in FIGS. 5, 6 and 12, cap 50 may be folded in on itself along generally transversely-extending fold 60. When folded in this manner, inner rear surface 59 of rear part 54 of crown 51 is generally folded into contact with inner front surface 56 of front part 53 of crown 51. Thus, rear part 54 is in a spooned or nested alignment with front part 53 of crown 51. Some caps are provided such that they can be easily folded in this manner.

Figure 7:
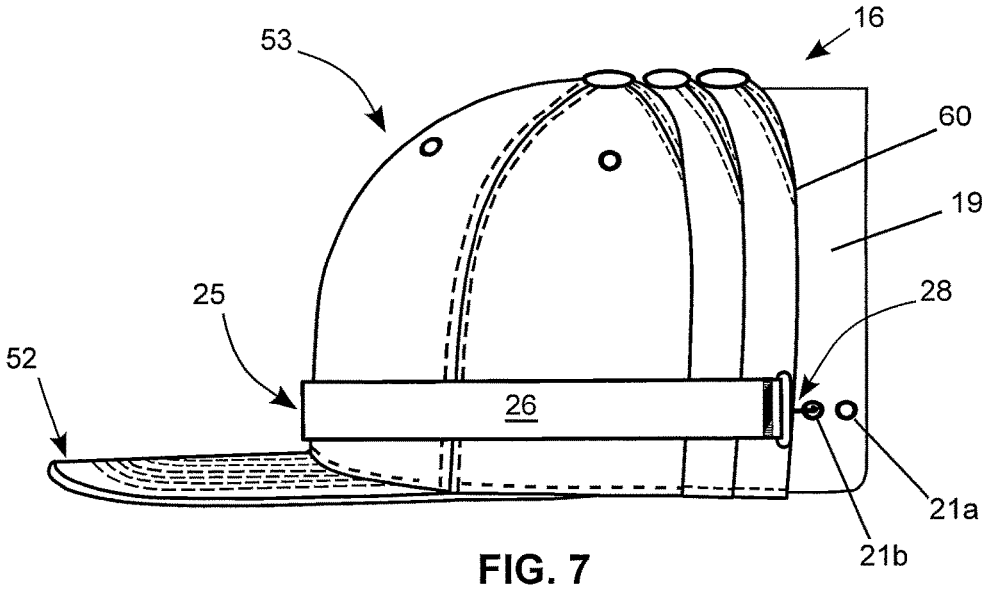
FIG. 7 is a side view of the cap protector shown in FIG. 5 in engagement with multiple conventional baseball caps.
Figure 8:
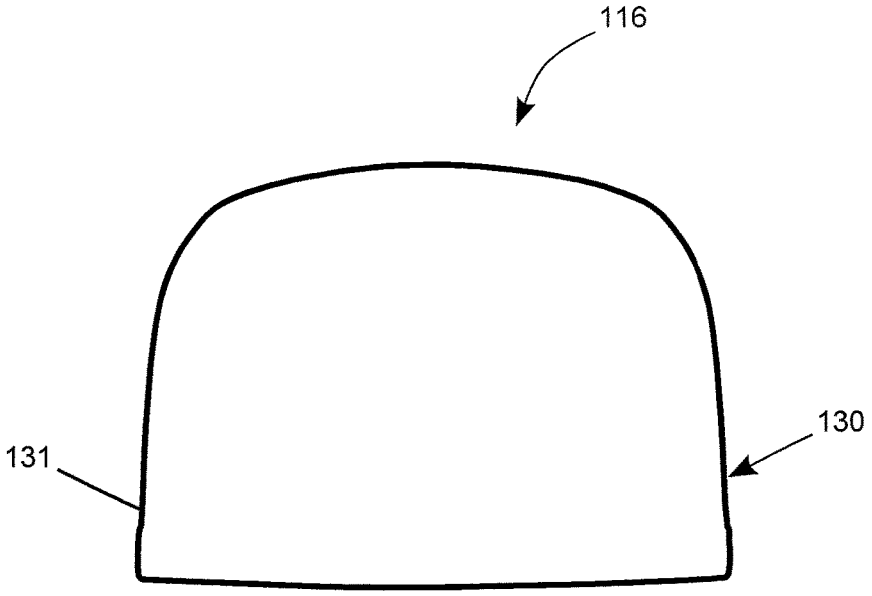
FIG. 8 is a front view of a second embodiment of the cap protector.
Figure 13:
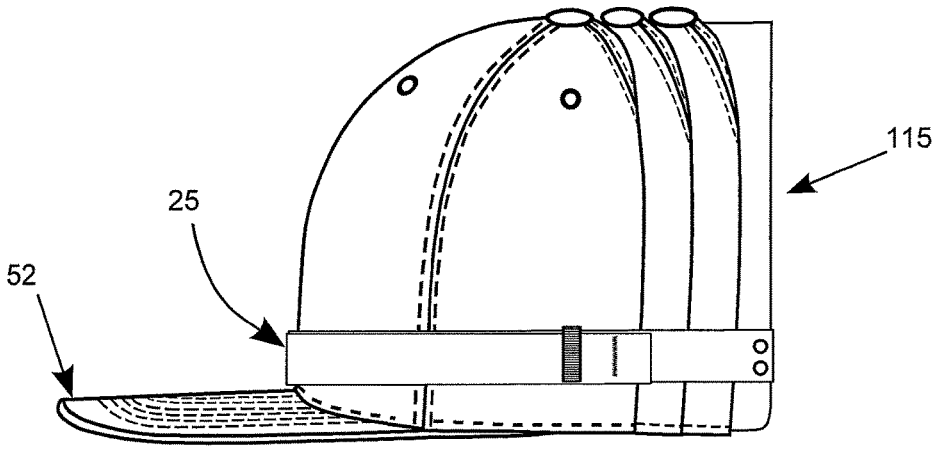
FIG. 13 is a side view of the cap protector shown in FIG. 9 in engagement with multiple conventional baseball caps.
Figure 14:
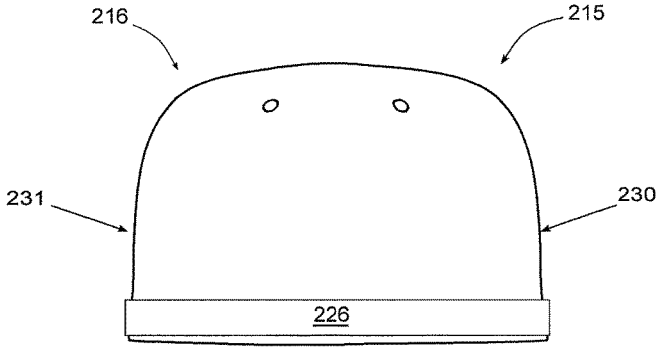
FIG. 14 is a front view of a third embodiment of the cap protector.

As shown in FIGS. 5, 6 and 12, cap protector 15 is designed to be used with cap 50 in a folded position. Baseball-type caps may be folded and then stacked in their folded shape as shown in FIGS. 7 and 13. Cap protector 15 is designed for use with caps that are in such a stacked arrangement.

In particular, cap protector body 16 of cap protector 15 is shaped to the preferred contours of the front part 53 of cap 50. In this embodiment, body 16 is a specially configured rigid plastic unitary member that has front surface 18 molded to the manufacturers preferred contour or shape for the front part 53 of cap 50, and more particularly to the preferred shape of front panels 51*a* and 51*f* of cap 50. Body 16 is thereby designed to be placed behind and against outer rear surface 58 of rear part 54 of crown 51 when cap 50 is in the folded configuration shown in FIGS. 5, 6, 7, 12 and 13. Thus, body 16 is designed to spoon or nest behind folded rear part 54 and front part 53 of crown 51. In use, rear part 54 is sandwiched between inner front surface 56 of front part 53 and front surface 18 of body 16. In this embodiment, body 16 is about 3/16ths of an inch thick and is formed of ABS plastic shaped at the front to the head mold of cap 50. If desired, a debossed logo may be molded into the plastic of body 16. Alternatively, for example, body 16 may be formed of EVA or other thermoplastics. Other materials may also be used to form body 16 so that it is generally rigid and not easily deformed, such as, for example, stainless steel or other alloys.

Figure 4:
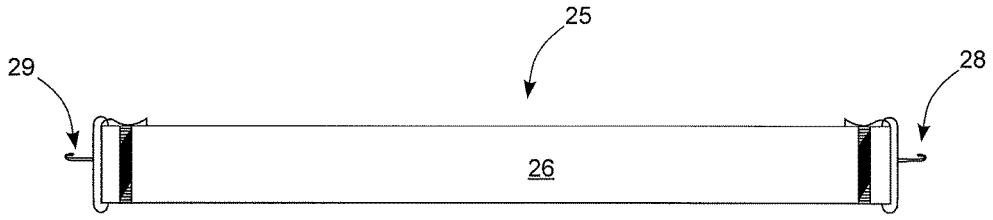
FIG. 4 is a front view of a first embodiment of the retaining strap of the cap protector.

To retain body 16 in place in this nested arrangement, and to apply some shape-retaining pressure from front surface 18 of body 16 to front part 53 of crown 51, retaining element 25 is provided. As shown in FIG. 4, retaining element 25 generally comprises elastic strap 26 having hook 28 at one end and hook 29 at the other end. In this embodiment, elastic strap 26 is about 1.5 inches in width and about 12 inches long.

As shown in FIG. 4, hooks 28 and 29 are connected to the respective looped and bar tacked ends of strap 26. In this embodiment, left and right rear portions 19 and 20 of body 16 are provided with a series of eyelets or openings 21*a-c* and 22*a-c* sized to receive hooks 28 and 29, respectively. In particular, three eyelets 21*a-c* are positioned at varying distances from lower left rear edge 30 of body 16. Eyelet 21*a* is positioned closest to left rear edge 30. Eyelet 21*b* is spaced further forward from rear edge 30 and eyelet 21*c* is spaced the greatest distance forward from rear edge 30. Similarly, on the right side of body 16, eyelet 22*a* is positioned closest to right rear edge 31, eyelet 22*b* is positioned an intermediate distance forward from rear edge 31 and eyelet 22*c* is positioned the furthest distance forward from right rear edge 31. Eyelets 21*a-c* and 22*a-c* thereby provide alternative positions for connections 23 and 24, respectively, to retaining element 25. In this way, if cap protector 15 is to be used with a single folded cap, as shown in FIGS. 5 and 6, eyelets 21*c* and 22*c* may be used with hooks 28 and 29, respectively, so that body 16 is held firmly against folded crown 51. However, if cap protector 15 is used with multiple nested caps, as shown in FIG. 7, eyelets 21*b* and 22*b* may be used with hooks 28 and 29, respectively, to provide left connection 23 and right connection 24 and the desired force of front surface 18 against folded crown 51. Thus, cap protector 15 is adapted to be used in multiple configurations. While hook and eyelet connections are shown in this embodiment, other removable or detachable connections may be used as alternatives. For example, hooks 28 and 29 and eyelets 21*a-c* and 22*a-c* may be replaced with snaps or other detachable fasteners.

In this embodiment, as shown in FIG. 5, body 16 is sized such that left rear side portion 19 and right rear side portion 20 extend at least in part beyond fold 60 of single cap 50. In addition, as shown in FIG. 7, body 16 may be configured so that at least part of portions 19 and 20 will extend beyond the fold 60 of the rearmost cap of multiple nested caps. In addition, openings 21*a-c* and 22*a-c* are positioned in body 16 in side portions 19 and 20, respectively, such that at least one eyelet extends and is exposed rearwardly of fold 60 both in a single configuration and in a multiple nested cap configuration. Due to this arrangement, strap 25 pulls body 16 into outer rear surface 58 of rear part 54 of crown 51 and in turn against inner front surface 56 of front part 53 of crown 51. This helps to either return the shape or protect the shape of front part 53 of crown 51 to a desired shape or contour, namely the contour of front surface 18 of body 16.

FIGS. 8-13 show second cap protector embodiment 115. In this embodiment, body 116 is similar in shape and size to first embodiment body 16. However, rather than removable hook and eyelet connections between retaining strap 26 and left and right portions 19 and 20 of body 16, permanent or fixed riveted connection 123 and ladder lock buckle connection 124 are provided.

Figure 9:
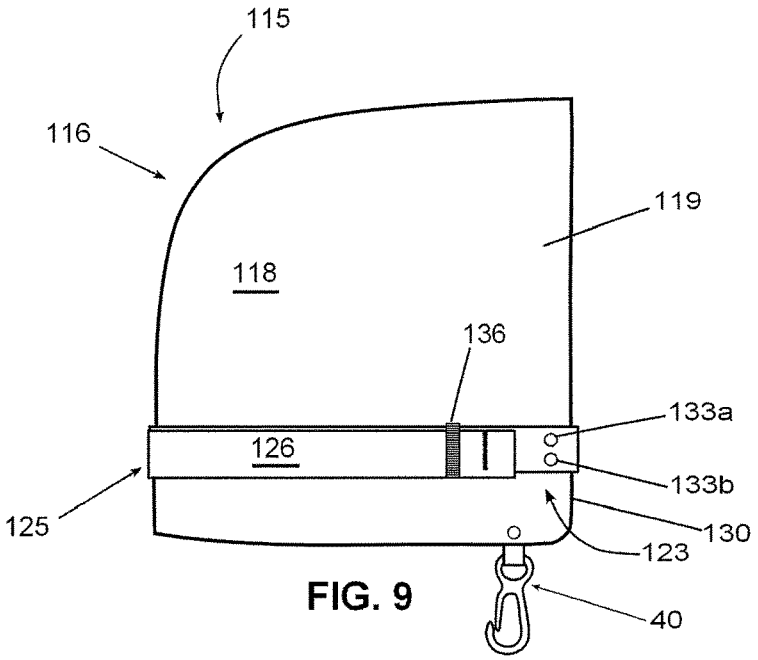
FIG. 9 is a left side view of the cap protector shown in FIG. 8.
Figure 10:
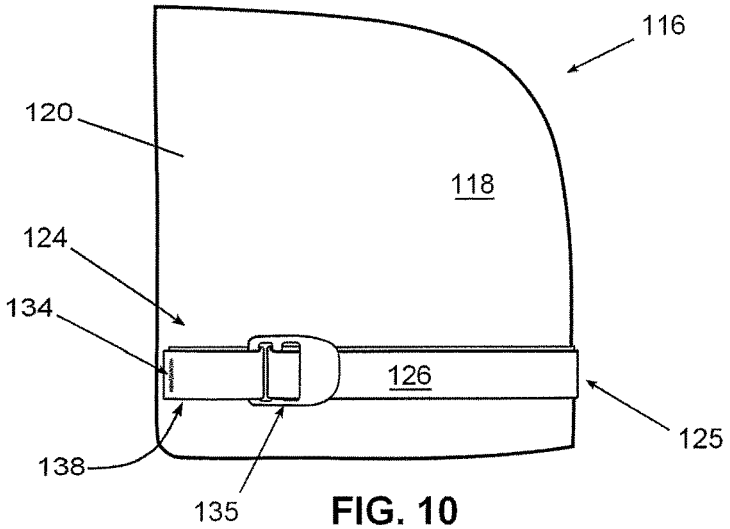
FIG. 10 is a right side view of the cap protector shown in FIG. 8
Figure 11:
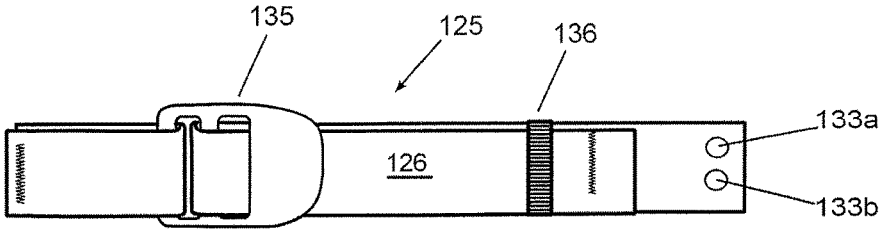
FIG. 11 is a front view of the retaining strap shown in FIG. 9.

In this embodiment, strap 126 of retaining element 125 is elastic webbing and is about 60 cm in length and about 2 cm in width. The strap length may be adjusted with ladder lock buckle 135. As shown in FIG. 10, ladder lock buckle 135 is connected to the bottom right side 120 of body 116 by web connection 124. In particular, webbing connector 138 is looped around the left bar of buckle 135 and its two ends bar tacked 134 to right portion 120 of body 116. Alternatively, for example, the ends may be double riveted to body 116. As shown in FIG. 9, one end of elastic strap 126 is folded around the left bottom rear edge 130 of body 116 and double riveted 133*a*, 133*b* to left portion 119 of body 116. Alternatively, for example, this end may be bar tacked to body 116. As shown in FIGS. 9-11, strap 126 is then extended around the lower front portion of surface 118 of body 116 and looped up and around the right bar of ladder lock buckle 135 and folded back onto itself to extend under the adjusting tab of buckle 135 and back around to retaining loop 136. Ladder lock buckle 135 is provided to allow for adjusting the length of strap 126 between rivet connection 123 on left portion 119 of body 116 and web connection 124 on right portion 120 of body 116. Elastic loop 136 is used to retain the portion of strap 126 that extends back from ladder lock buckle 135.

As shown in FIGS. 12 and 13, cap protector 115 may be used, as in the first embodiment, with either a single folded cap or with multiple folded nested caps. The length of strap 126 is adjusted to allow for the desired tension for the desired number of folded nested caps. As with the first embodiment, body 116 is sized such that left rear side portion 119 and right rear side portion 120 extend at least in part beyond fold 60 of single cap 50. In addition, body 116 may be configured so that at least part of portions 119 and 120 will extend beyond fold 60 of the rearmost cap of multiple nested caps. In addition, rivet and loop connections 123 and 124, respectively, are positioned on body 116 in side portions 119 and 120, respectively, such that they are rearward of fold 60 both in a single configuration and in a multiple nested cap configuration. Due to this arrangement, strap 125 pulls body 116 into outer rear surface 58 of rear part 54 of crown 51 and in turn against inner front surface 56 of front part 53 of crown 51. This helps to either return the shape or protect the shape of front part 53 of crown 51 to a desired shape or contour, namely the contour of front surface 118 of body 116.

As shown in FIG. 9, conventional snap hook 40 is connected to the bottom left corner of body 116. This allows for cap protector 116 to be removably attached to a pack, bag or other object. Thus, cap protector 115 may be nested with and used to hold one or more caps and to attach such cap(s) to another object when not being worn in a manner that also protects or maintains the desired shape of the cap.

FIGS. 14-17 show a third cap protector embodiment 215. In this embodiment, body 216 is similar in shape and size to second embodiment body 116. However, rather than rivet and loop connections 123 and 124 between retaining strap 126 and left and right portions 119 and 120, respectively, of body 116, permanent bar tack connections are provided.

In this embodiment, strap 226 is elastic and is about 31 centimeters in length and about 1.5 centimeters in width. In this embodiment, strap 226 is not configured to be adjusted in length. One end of elastic strap 226 is folded or wrapped around the left bottom rear edge 230 of body 216 and permanently connected or affixed to left portion 219 of body 216 by bar tack 223. The other end of strap 226 is in turn folded or wrapped around the left bottom edge 231 of right side portion 220 of body 216 and permanently connected to right side portion 220 by bar tack 224.

Figure 15:
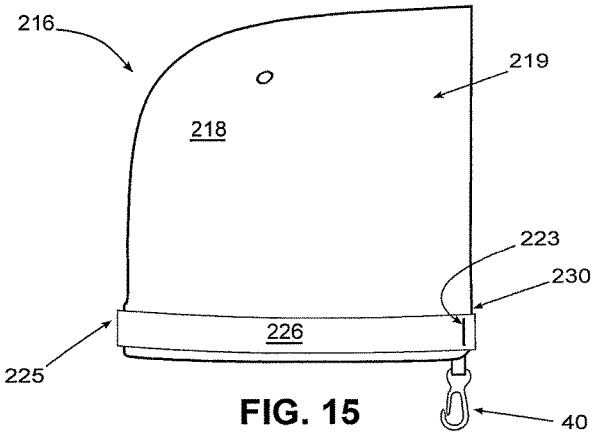
FIG. 15 is a left side view of the cap protector shown in FIG. 14.
Figure 16:
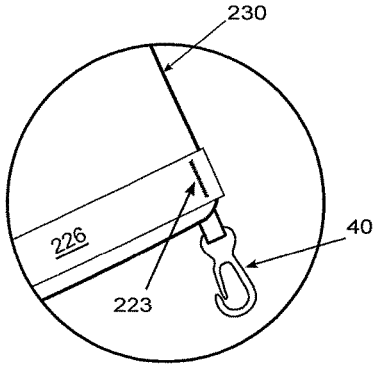
FIG. 16 is an enlarged view of the connection shown in FIG. 15.
Figure 17:
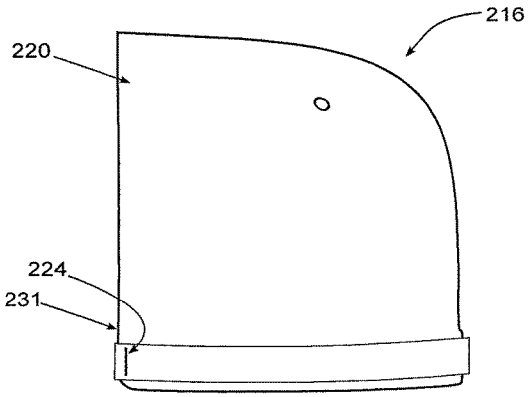
FIG. 17 is a right side view of the cap protector shown in FIG. 14.

As in the first two embodiments, cap protector 215 may be used with either a single folded cap or with multiple folded nested caps. As shown in FIGS. 15 and 16, a conventional snap hook 40 is connected by bar tack 223 to the bottom left corner of body 216. Again, this allows for cap protector 216 to be removable attached to a pack, bag or other object.

Figure 20:
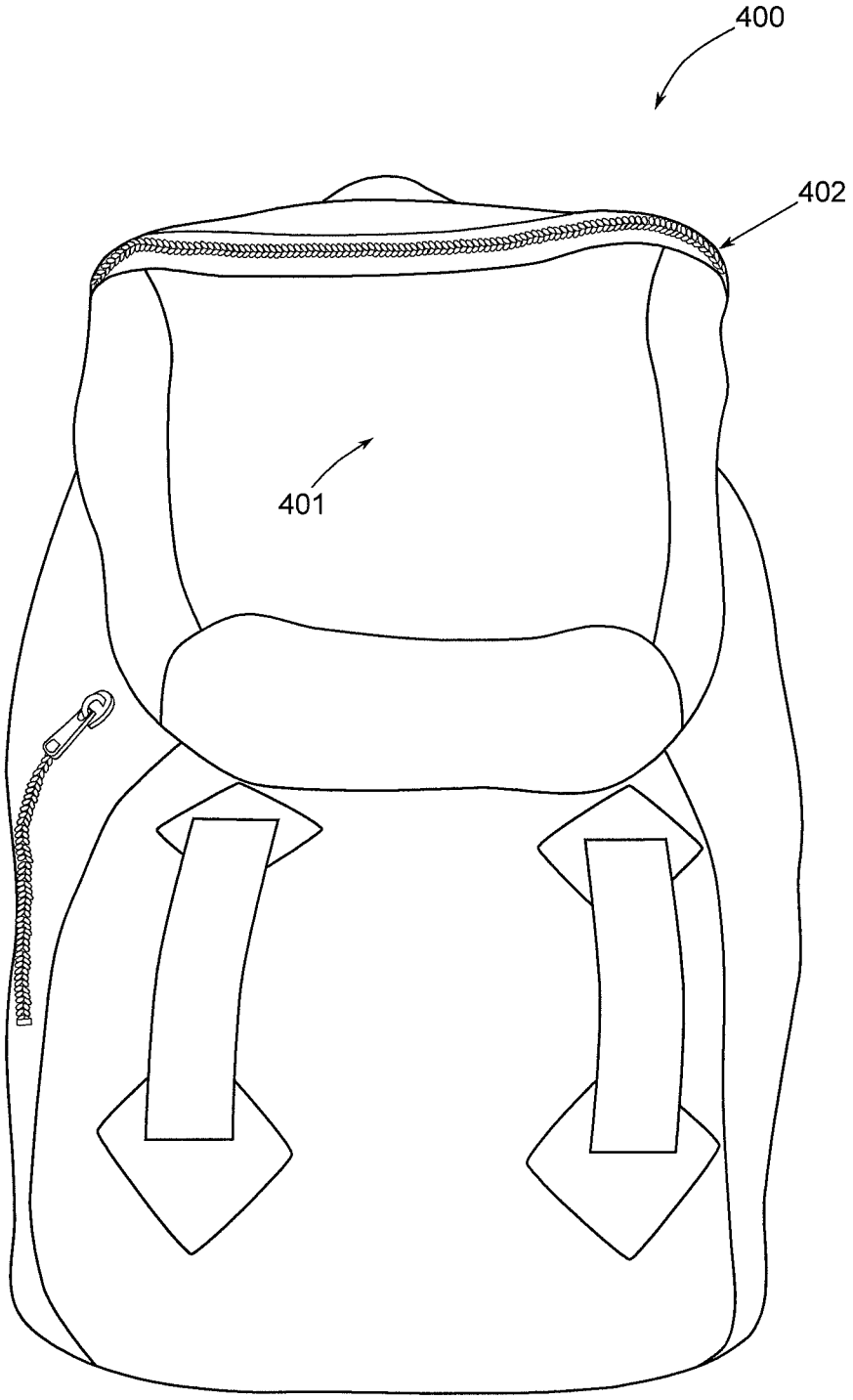
FIG. 20 is a perspective view of an embodiment of a carrier having a cap pocket.
Figure 21:
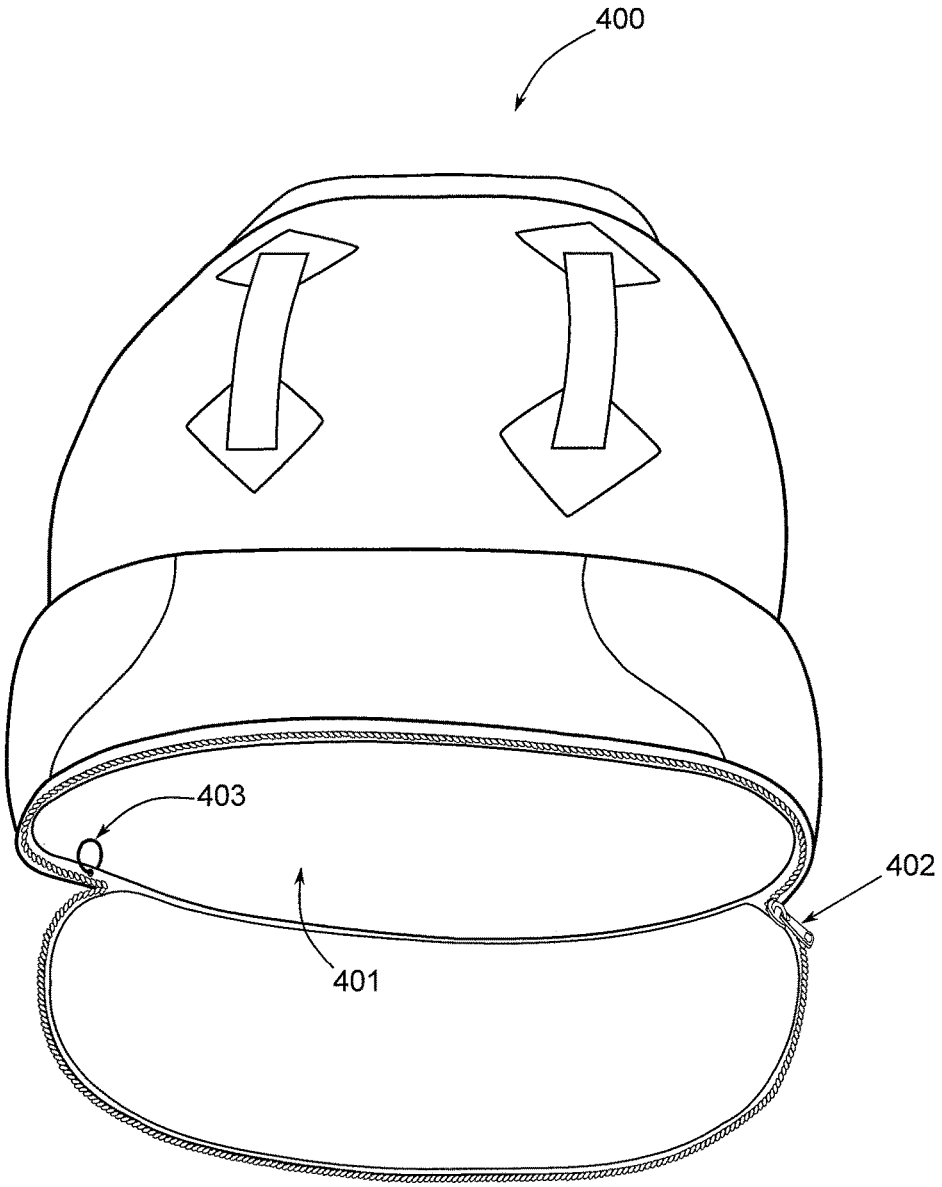
FIG. 21 is perspective view of the pack shown in FIG. 20 with the cap pocket open.
Figure 22:
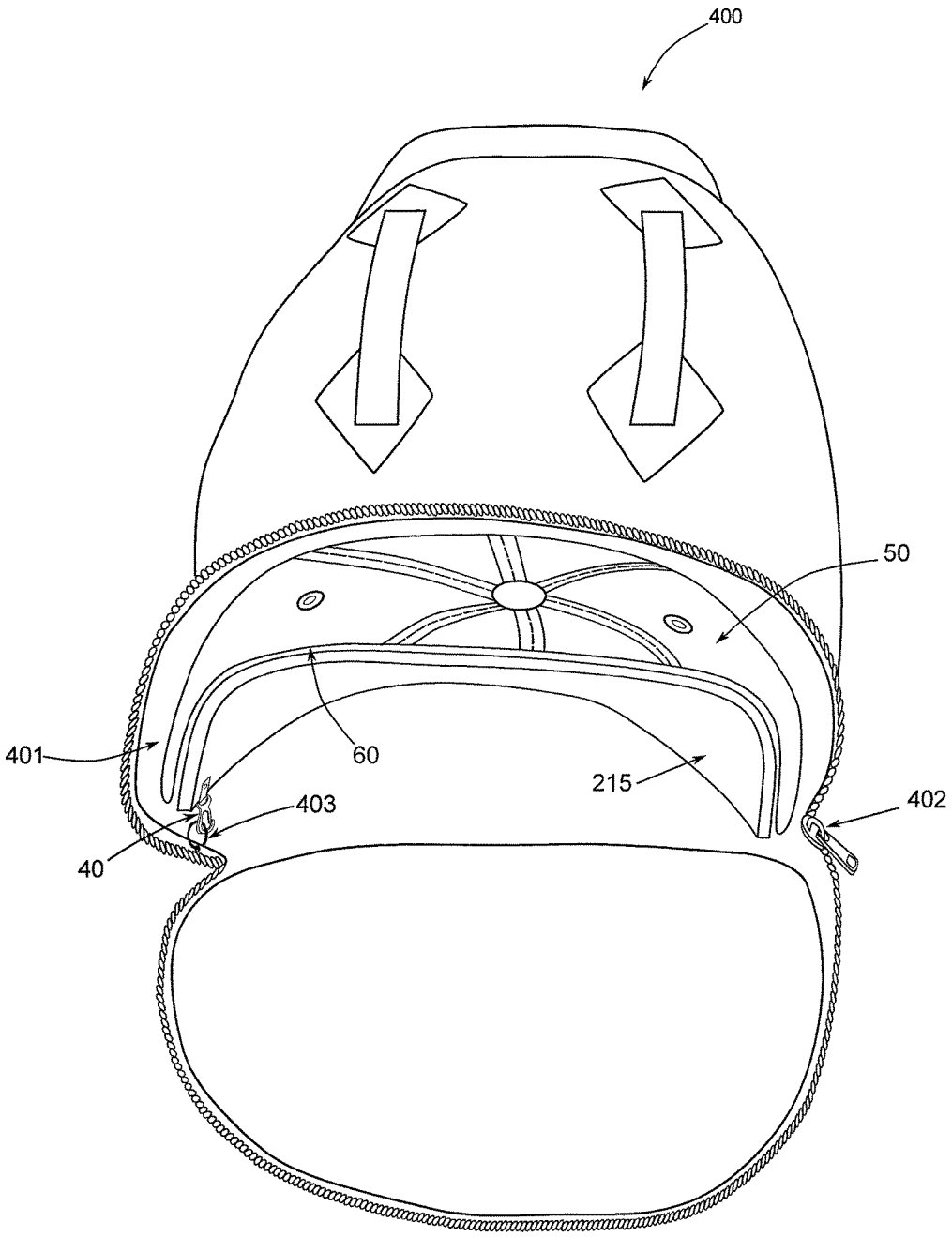
FIG. 22 is perspective view of the pack shown in FIG. 21 with a cap and cap protector inserted in the cap pocket.

As shown in FIGS. 20-22, cap protector 215 may be used together with a specially configured pack or other carrying device, such as, for example, a duffel, carryall, knapsack, tote, satchel or other bag. In this embodiment, small back pack 400 is provided for use with cap protector 215. As shown, pack 400 includes a specially configured and sized cap pocket 401. In this embodiment, pocket 401 is located on the top outer portion of pack 400 and may be closed with zipper 402. However, pocket 401 may be located other places, such as, for example, at the front or side of the pack.

Pocket 401 is sized so that cap 50 and cap protector 215 may be inserted into pocket 401 bill first and such that all of cap 50 and cap protector 215 are contained within pocket 401 when zipper 402 is closed without having to deform cap 50 or cap protector 215. Because pocket 401 is a soft pocket, cap 50 could be crushed if pack 400 were placed with pocket 401 against a hard surface. To keep cap 50 from being crushed, cap protector 215 is positioned to engage cap 50, as shown with respect to cap protector 115 in FIG. 12, and both cap 50 and cap protector 216 are inserted together in nested engagement within specially designed pocket 401.

As shown in FIG. 22, pocket 401 includes ring connector 403 fixed to the interior of pocket 401 adjacent the left side of the opening of pocket 401. Ring 403 is positioned to align and be within connecting distance of hook 40 of cap protector 215 when cap protector 215 and cap 50 are properly positioned in pocket 401. Cap protector 215 may thereby be clipped with snap hook 40 to ring 403 so that cap 50 and cap protector 215 can be removed from pocket 401, and then cap 50 may be removed from engagement with cap protector 215, without detaching hook 40 and cap protector 215 from ring 403 and pack 400. With this configuration, cap 50 may be removed from pocket 401 and worn without fear of losing or misplacing cap protector 215, as it can remain hooked to pack 400. Other removable connectors may be used. For example, a hook similar to hook 40 may be used instead of ring 403 or a snap fastener may be used. Thus, cap protector 215 may be nested with and used to hold one or more caps and to protect such caps when stored in pack pocket 401 of pack 400 in a manner that protects or maintains the desired shape of the cap.

The present invention contemplates that many changes and modifications may be made. Therefore, while the presently-preferred form of the cap protector has been shown and described, and several modifications and alternatives discussed, persons skilled in this art will readily appreciate that various additional changes and modifications may be made without departing from the spirit of the invention, as defined and differentiated by the following claims.

What is claimed is:

1. A protector for a cap, said cap having a generally domed crown and a bill connected to said crown and extending away from said crown, said crown comprising a front generally half domed part and a rear generally half domed part, said front part having an outer front surface and an inner front surface, said rear part having an outer rear surface and an inner rear surface, said inner front surface and said inner rear surface defining an interior cavity for receiving the head of a wearer, comprising:

a substantially rigid body having a front generally half-domed surface configured and arranged to follow contours of said front part of said crown of said cap, a left side portion and a right side portion;

a retaining element configured and arranged to extend from a first connection on said left side portion of said body around said outer front surface of said front part of said crown above said bill to a second connection on said right side portion of said body;

wherein said body and said retaining element are configured and arranged such that said front surface of said body engages said outer rear surface of said rear part of said crown when said rear part is folded into said front part at a substantially transversely extending fold; and wherein said shape of said front part of said crown is protected by said front surface of said body.

2. The cap protector set forth in claim 1, wherein said body comprises plastic.

3. The cap protector set forth in claim 1, wherein said retaining element comprises a woven twill strap.

4. The cap protector set forth in claim 1, wherein said retaining element is adjustable in length.

5. The cap protector set forth in claim 1, wherein said retaining element is elastic.

6. The cap protector set forth in claim 1, wherein said first connection is a removable connection.

7. The cap protector set forth in claim 6, wherein said first connection comprises a hook and an opening in said body for receiving said hook.

8. The cap protector set forth in claim 1, wherein said first connection is a fixed connection.

9. The cap protector set forth in claim 8, wherein said first connection comprises a rivet.

10. The cap protector set forth in claim 8, wherein said first connection and said second connection comprise bar tacks.

11. The cap protector set forth in claim 1, wherein said body comprises a connecting element for removably connecting said body to a bag or pack.

12. The cap protector set forth in claim 11, wherein said connecting element comprises a latch hook.

13. The cap protector set forth in claim 1, wherein said bill extends away from said crown in a first direction and said left side portion and said right side portions are each configured and arranged to extend beyond said cap fold in a second direction opposite to said first direction.

14. The cap protector set forth in claim 1, and further comprising a carrier having a flexible pocket configured and arranged to receive said cap protector in engagement with a cap.

15. The cap protector set forth in claim 14, wherein said carrier comprises a pack and said pocket is located on the top of said pack and includes a zipper closure.

16. The cap protector set forth in claim 14, wherein said pocket includes a first connecting element and said body comprises a second connecting element for removably connecting said body to said first connecting element.

17. The cap protector set forth in claim 16, wherein said first connecting element comprises a ring and said second connecting element comprises a latch hook.

* * * * *